United States Patent [19]

Sykora

[11] 4,304,355

[45] Dec. 8, 1981

[54] CONTAINER ASSEMBLY FOR ICE-CREAM PRODUCTS

[75] Inventor: John M. Sykora, Chicago, Ill.

[73] Assignee: Field Container Corp., Elk Grove Village, Ill.

[21] Appl. No.: 229,725

[22] Filed: Jan. 29, 1981

Related U.S. Application Data

[63] Continuation-in-part of Ser. No. 32,118, Apr. 23, 1979, Pat. No. 4,258,875.

[51] Int. Cl.[3] ..... B65D 45/18

[52] U.S. Cl. ..... 229/43; 229/41 B; 229/45 R

[58] Field of Search ..... 229/43, 45, 41 B, 37 R

[56] References Cited

U.S. PATENT DOCUMENTS

| | | | |
|---|---|---|---|
| 2,185,604 | 1/1940 | Moore | 229/43 |
| 2,768,777 | 10/1956 | Barrington et al. | 229/45 R X |
| 3,195,798 | 7/1965 | Wilson | 229/37 R |
| 3,219,255 | 11/1965 | Holmes | 229/39 R |
| 3,512,699 | 5/1970 | Wilson | 229/37 R X |
| 3,520,468 | 7/1970 | Wiemann | 229/45 R |
| 3,958,747 | 5/1976 | Chipp et al. | 229/45 R |
| 4,258,875 | 3/1981 | Sykora | 229/41 B |

*Primary Examiner*—Davis T. Moorhead
*Attorney, Agent, or Firm*—Alter and Weiss

[57] ABSTRACT

A knock-down container assembly for packaging and containing ice-cream products wherein an articulated carton portion cooperates with an articulated cover portion through closure features which effectively lock the cover portion in place on top of the carton portion. Various protuberances or locking flaps in the carton portion cooperate with recesses or notched regions in the cover portion respectively to provide these locking features. The carton itself is constructed to contain either a standardized half-gallon volume of ice-cream products and is especially adapted for utilization on standard existing ice-cream product packing machinery.

15 Claims, 16 Drawing Figures

CONTAINER ASSEMBLY FOR ICE-CREAM PRODUCTS

BACKGROUND OF THE INVENTION

This is a continuation-in-part application of applicant's earlier filed co-pending application, Ser. No. 32,118, filed Apr. 23, 1979, now U.S. Pat. No. 4,258,875, issued Mar. 31, 1981.

The present invention relates in general to packaging containers and in particular to a knock-down container assembly for packaging and containing ice-cream products.

Packaging products for containing ice-cream products such as ice-cream, ice-milk, sherbet and the like, of course, have been in existence for as long as such ice-cream products have existed. Of the several varied forms of such containers, the two most widely known and used forms are the conventional half-gallon and pint rectangular packages using tongue in slot closure means and the half-gallon quart or pint cylindrical container utilizing a circular cover. Unfortunately, these two predominant types of ice-cream products packages have associated with them several disadvantages which the present invention alleviates so as to be an improvement thereon.

For example, the standard rectangular package using a tongue flap and a slotted flap with nested flaps thereunder serves to seal the ice-cream most effectively when the ice-cream container itself is full, since the nested flaps are in closed sealing proximity to the actual contents of the package. However, when the package is repeatedly opened and shut and the contents are withdrawn, there is a tendency for the nested flaps to "gap" in the absence of actual ice-cream sealed against it, so as to let in air and other impurities which tend to either "crystallize" the ice-cream or have undesirable effects in the way of odor, contamination and the like on the remaining ice-cream product left in the container.

Yet, additional disadvantages are encountered in the utilization of cylindrical circular type ice-cream product containers which are most notably utilized with "custom" ice-cream products. Further, these circular cylindrical containers are not readily adaptable to existing packaging machinery of the type most ordinarily used in the ice-cream industry, namely machinery produced by such companies as Anderson Brothers Corporation of Rockford, IL. Accordingly, the filling and formation operations associated with them are more costly. Because of their inefficient utilization of space in manufacturer's finished goods storage, refrigerated delivery trucks and retail display cabinets, they create increased costs in inventorying and delivery expenses. These round containers, for the most part, are not formed during the actual on-line production process but rather need to be nested and are not adaptable to preformation. In cases where in-plant preformation of non-nested cylindrical containers is possible a major capital committment is necessary. Additionally, the available rectangular-shaped containers of the conventional type do not have a separate cover to effectively reseal the container and the round cylindrical containers fail to utilize positive cover securement means which reduce the inadvertent separation of the cover and the carton or container portions to, in turn, reduce contamination of the ice-cream products contained therein. The conventional rectangular containers, for the most part, fail to lend themselves to effectively reducing the crystallization process of remaining ice-cream contents in their respective containers.

With this in mind, it becomes an object of the present invention to provide an effectively sealed ice-cream product container capable of accepting standard measures of ice-cream products in the half-gallon or one-quart sizes by retaining the standard rectangular dimensions of the container for conventional packaging machinery while only reducing the height of the container.

It is a further object of the invention to eliminate gapping of the container closure means so as to more efficiently seal the ice-cream product contents so as to reduce crystallization and contamination.

It is also an object of the present invention to provide a container assembly which is directed to and readily adaptable for in-line formation and filling on existing conventional packaging machinery in order to reduce costs associated therewith. Further, it is an object of the present invention to provide an efficient container for such products which facilitates the effort and reduces costs involved with keeping an inventory of such products, as well as with shipping such products by reducing the amount of required space to keep an inventory or for shipping. In so doing, it is further an object to provide such a container which stacks and stores better, which needs not be nested, and which utilizes cover means which can be formed on-line rather than requiring preformation before the packaging and shipping operation.

These and other objects of the invention shall become apparent in light of the present specification.

SUMMARY OF THE INVENTION

The present invention comprises a knock-down container form assembly for packaging and containing ice-cream products. The assembly includes a one-piece, knock-down rectangular carton portion, as well as a one-piece, knock-down cover portion for attachment thereto.

The one piece knock-down carton portion comprises a front panel, a back panel and two side panels interposed therebetween. At the bottom of the carton are bottom formation means, formed by a plurality of flaps emanating from the bottom end of the front, back and side panels which, when articulated, form a bottom panel on the carton. Additionally, one or more of the front, back and side panels of the carton have carton closure means emanating at the tops of the panels for cooperation with the cover means to effectively maintain the cover portion in its closed position on top of the carton portion. This cover portion, upon articulation, has substantially the same shape rectangularly, as the top of the carton (upon articulation) so that the cover portion itself can be telescopically, yet closely, received by the carton.

The cover portion itself comprises a top panel and a plurality of cover side panels attached to this top panel. The top and side panels of the cover portion have cover closure means which cooperate with the carton closure means so as to effectively affix the cover portion to the carton portion.

In the preferred embodiment of the invention, the rectangular carton portion is preliminarily formed into a rectangular-shaped tube through carton strip connection means which fixedly juxtapose one of the side panels to one of the proximate front or back panels. This strip connection means comprises an attachment strip which is fixedly attached through adhesive affixation between the side panel and either the front or back panel. Equivalently, the cover portion is capable of being articulated into its rectangular-shape through cover strip connection means interposed between the top and side panels of the cover. These cover strip connection means comprise a plurality of cover strips which successively juxtapose the side edges of the side panels through adhesive attachment therebetween.

In this preferred embodiment, a bottom panel is formed, partially from a slotted flap emanating from one of either of the front, back or side panels and a tongue flap which is capable of being received by the slotted flap and locked thereinto. The tongue flap emanates from another of the front, back or side panels which is positioned oppositely from the panel from which the slotted flap emanates. Additionally, this bottom panel further comprises a plurality of sealing flaps which nest when the cover portion is articulated so as to be positioned between the locked tongue slotted-flaps and the bottom aperture from by the bottom ends of the front, back and side panels. In this embodiment, each of the sealing flaps emanates from the front, back or side panels not having the tongue or slotted-flaps emanating therefrom.

In one embodiment of the invention the carton closure means comprises a plurality of carton closure flaps emanating from the top ends of one or more of the front back and side panels. One or more of these closure flaps are biased downwardly and restrained by adhesive over the top of the panel from which it emanates for inverted receipt of these closure flaps by the cover closure means in the cover portion when the cover portion is telescopically fitted over the carton portion. Preferably, such carton closure means of this embodiment comprise all four of the closure flaps emanating from the top of each of the side panels in the carton portion being biased outwardly and downwardly. Additionally, one or more of these closure flaps has release tab means attached thereto for positioning the closure flap itself closely juxtaposed to the panel from which the closure flap emanates so as to enable facilitated release of the closure flap from the cover closure means when the release tab means is depressed. Additionally, one or more of the emanating closure flaps is restrainably affixed to its respective juxtaposed panels in a substantially biased position which prompts interlocking between the cover and carton.

In the embodiment of the invention wherein the downwardly biased closure flaps are used, the cover closure means itself comprises a plurality of recesses in one or more of the cover side panels. Each of these recesses are shaped to snugly receive each of the one or more closure flaps of the carton respectively through urging of these closure flaps of the carton into the respective recesses when the cover portion is telescopically fitted over the carton portion. The closure flaps thereby nest into these recesses to preclude the inadvertent and undesired removal of the cover portion from the carton portion. The previously mentioned release tabs operate, when depressed, to remove the one or more closure flaps from their respective recesses so as to dislodge the nested flaps from their positions within the recesses and, in turn, facilitate removal of the cover portion from the carton portion.

In this particular embodiment of the invention, wherein downwardly biased closure flaps are utilized, the invention is envisioned as further comprising yet additional carton closure means comprising a plurality of bossed ridges positioned closely proximate to the top of one or more of the front, back and side panels in order to increase the frictional fit between the telescopically received cover portion and carton portion. Preferably, these bossed ridges are positioned closely proximate to the tops of each of the front and back panels particularly. Additionally, the cover portion itself has a plurality of bossed ridges in one or more of the cover side panels to increase the frictional fit between the carton and cover portions. Indeed, an embodiment of this invention calls for the utilization of such a plurality of bossed ridges on both the carton portion and the cover portion which are aligned, wherein the bossed ridges on each of these portions slide past one another upon telescopic fitment of the cover onto the carton portion so as to create a "fastening" of one bossed ridge behind the other to additionally fixedly secure the position of the cover portion onto the carton portion.

Notwithstanding what type of closure means are utilized between the carton and the cover with regard to the particular type or structural features of the closure flaps, it should be realized that such bossed ridges as previously discussed may be used to increase the frictional fit between the covering carton portions, or fasten behind one another. Thus, bossed ridges may be used on the carton portion alone, the cover portion alone, or on both the carton and cover portion to increase frictional fit involved in telescopic receipt, or, to permit the "fastening" of the bossed ridges from one element behind the bossed ridges of the other element so as to keep both elements, here the carton and cover portions, in fixed position relative to one another.

In yet another embodiment, the carton closure means comprise a plurality of closure flaps which equivalently emanate from the top of one or more of the front, back or side panels wherein the closure flaps have plurality of shear protuberances at the sides of the closure flaps which are received by the cover closure means in the cover portion when the cover portion is telescopically fitted over the carton portion. In this embodiment, the cover closure means comprises a plurality of notched regions between the cover side panels and the top panel of the cover which are aligned with the positions of the shear protuberances so as to receive these protuberances when the cover is telescopically fit onto the carton portion. By "snapping" into these notched regions and the cover portion, the shear protuberances further restrain the cover portion to the carton portion to preclude inadvertent separation therebetween. Further, in this embodiment, the shear protuberances are positioned at each of the opposing side edges of the closure flap emanating from one or more of the front, back and side panels making up the carton portion. In this embodiment also, it is envisioned that bossed ridges in both the carton and cover portions cooperate with one another in alignment to further secure the cover portion to the carton portion. In another embodiment of the invention, the carton closure means comprises a plurality of closure flaps which emanate from the top of one or more of the back, front or side panels. One or more of these closure flaps have a plurality of shear protuberances positioned between that flap, and the front, back or side panel from which it actually emanates. In this embodiment the cover closure means equivalently comprises a plurality of notched regions between the cover side panels and the top panel of said cover aligned with the positions of the shear protuberances so as to receive the protuberances when the cover portion is telescopically fitted over the carton portion to, in turn, effectively restrain the cover portion in its position of attachment to the carton portion. In the preferred version of this embodiment, the carton closure means also includes an additional plurality of protuberances which emanates from the sides of the closure flap which, upon articulation of the carton portion, become aligned with the shear protuberances emanating from the region between the closure flaps and the panel from which it is emanating.

Again, in this particular embodiment, as well as its preferred version, it is envisioned to utilize a series of bossed ridges in connection with either one or the other of the cover and carton portions, as well as both.

In the preferred embodiment similarly, the carton portion comprises a standard rectangularly-shaped one-half gallon capacity container. Alternatively, the carton portion comprises a standard rectangularly-shaped one-quart capacity container. In either of the two preferred size embodiments, however, the carton portion would be of such a rectangular-shape, as to be readily adaptable to the packing operation as performed on conventional ice-cream product packaging equipment.

DETAILED DESCRIPTION OF THE DRAWINGS

Figure 1:
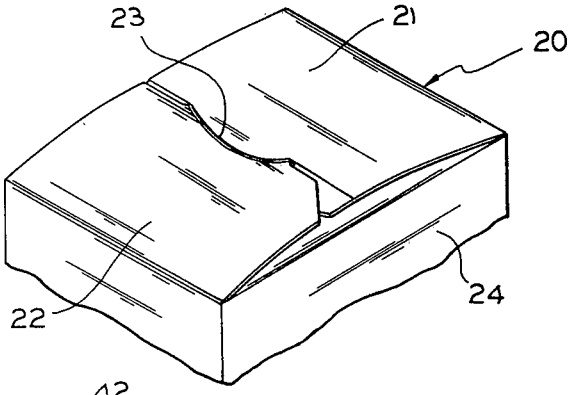
FIG. 1 of the drawings is a top perspective view of the closure means of conventional ice-cream packaging containers which utilize a tongue in groove closing construction.

While this invention is susceptible of embodiment in many different forms, there are shown in the drawings and will herein be described in detail, several specific embodiments, with the understanding that the present disclosure is to be considered as an exemplification of the principles of the invention and is not intended to limit the invention to the embodiment illustrated.

FIG. 1 of the drawings shows the conventional type of ice-cream container closure means wherein a tongue on flap 22 locks into slot 23 on flap 21. In this conventional packaging, container 20 would have comparable closure means both at the top and bottom of the container. In the present invention, the use of such a slotted and tongued flapped closing technique is confined to the bottom panel as shown by reference numerals 26 through 31 of FIG. 2.

Figure 2:
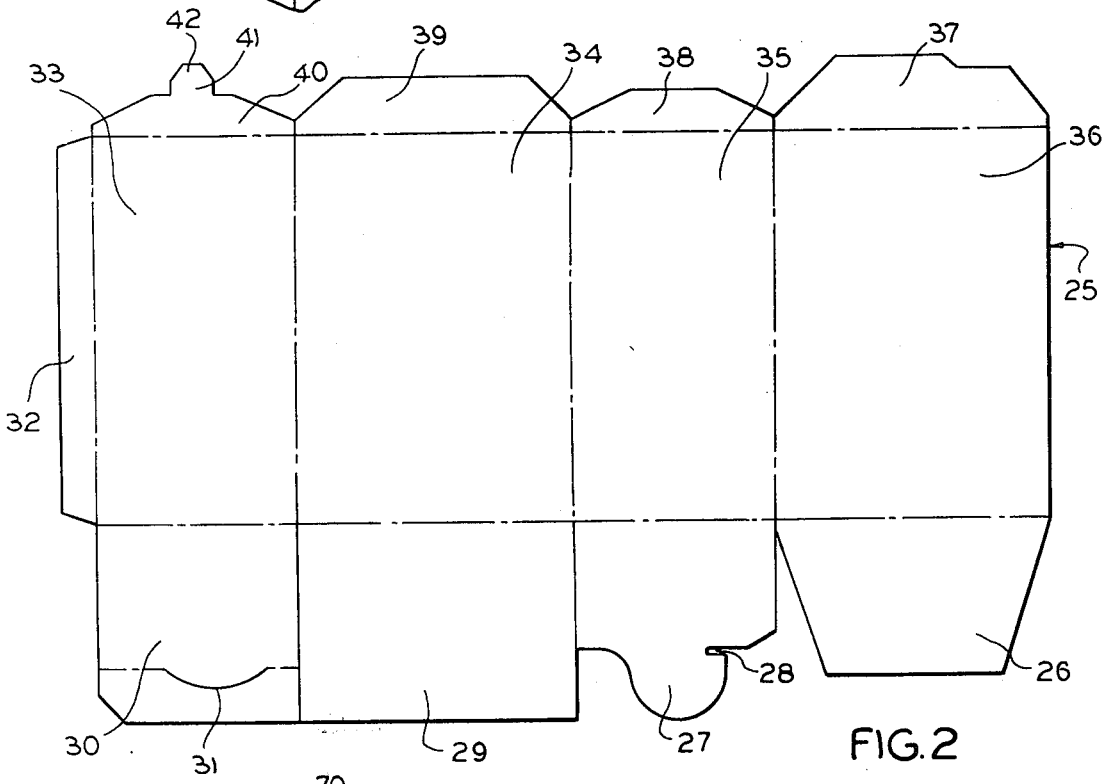
FIG. 2 of the drawings is a front elevational view of the knock-down carton blank wherein tab release means are utilized.

One embodiment of the present invention is shown in FIG. 2 wherein container 25 is shown in its unarticulated configuration as comprising a one-piece, knock-down rectangular carton portion. As described, the bottom panel is made up of slotted flap 30 with slot 31, and tongued flap 27 with locking notch 28, as well as sealing flaps 26 and 29 which nest together immediately inside the slotted and tongued flaps to seal the bottom aperture of the container. Sealing strip 32, through an adhesive material, fastens side 33 to front panel 36, upon articulation, to shape the carton portion into a tube before its upper and lower ends are further formed or covered. Back panel 34 and side panel 35 cooperate with panels 33 and 36 to form the rectangular carton upon articulation. Closure flaps 37, 39, 38 and 40 emanate from the front, back and side panels respectively to provide closure elements with which mated closure means in the cover portion cooperate to maintain the cover and carton portions in the sealed position. In this particular embodiment, closure flaps 38 and 40 are specifically shaped and are biased downwardly over panels 35 and 33 respectively to, in turn, be received and locked into recesses in the cover portion which are shown, before articulation, in FIG. 3.

Figure 3:
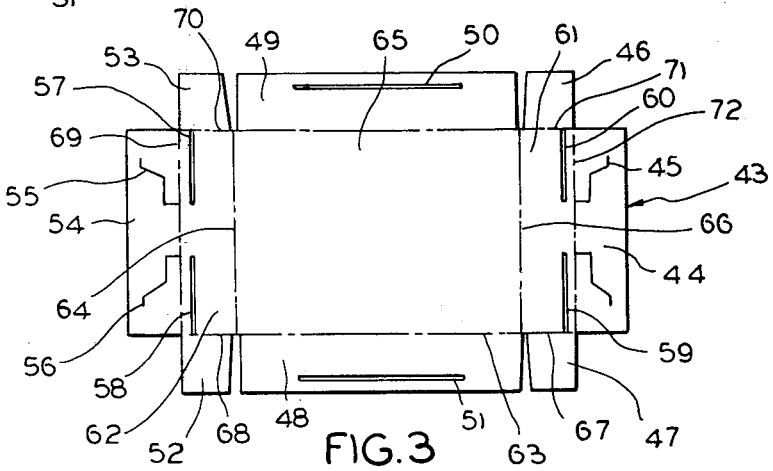
FIG. 3 is a front elevational view of the cover portion which cooperates with the carton portion of FIG. 2.

Cover portion 43 is shown in FIG. 3 before articulation as comprising top panel 65 and side panels 44, 49, 62 and 48; which are separated by folds such as folds 64 and 66 separating sides 62 and 61 from top panel 65. Cover strips 46, 47, 52 and 53, upon articulation, connect the side panels of the cover to one another in succession through the use of adhesive materials to enable connection, for example, of side 48 to side 62 at a ninety degree angle when strip 52 is adhesively attached to the interior of side 48.

Figure 4:
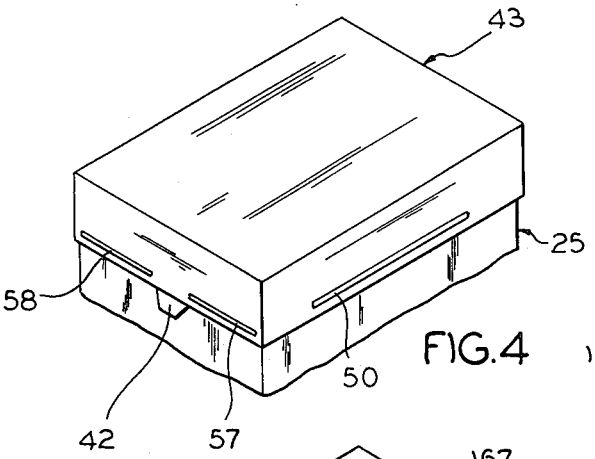
FIG. 4 is a top perspective view of the cover portion of FIG. 3 telescopically received in place upon the top of the carton portion of FIG. 2.
Figure 8:
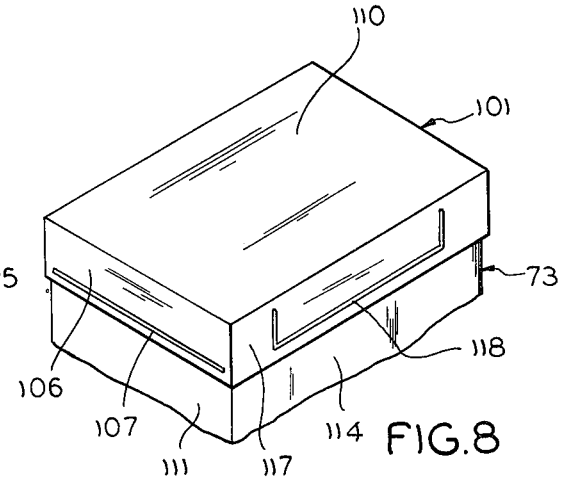
FIG. 8 is a view of the cover portion of FIG. 7 in place over the top of the carton portion of FIG. 6.
Figure 12:
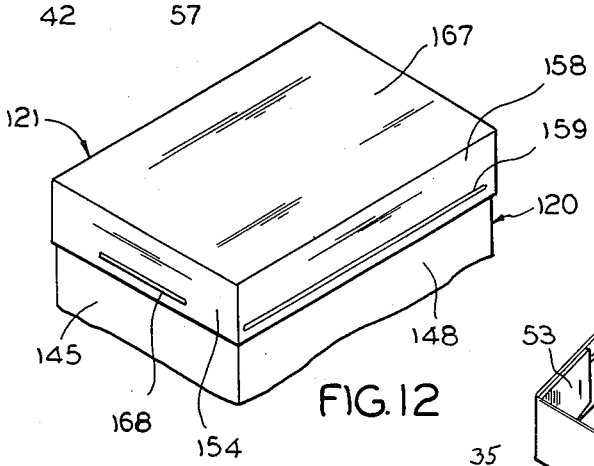
FIG. 12 is a top perspective view of the cover portion of FIG. 11 affixed to the carton portion of FIG. 10.
Figure 5:
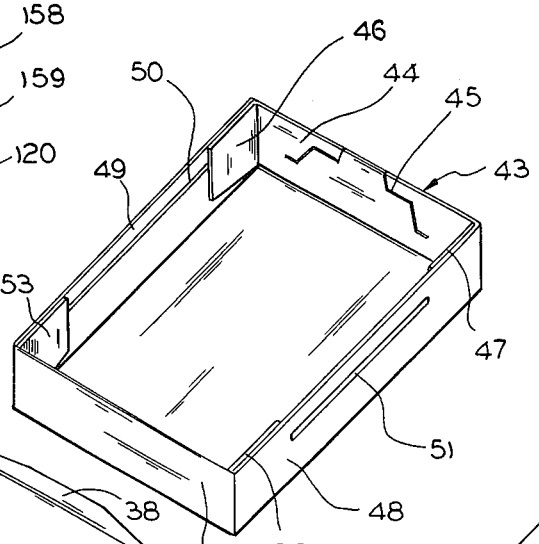
FIG. 5 is a top perspective view of both the carton and cover portions of FIGS. 2 and 3 respectively, showing particularly their closure means which cooperate to keep them in position relative to one another.
Figure 5:
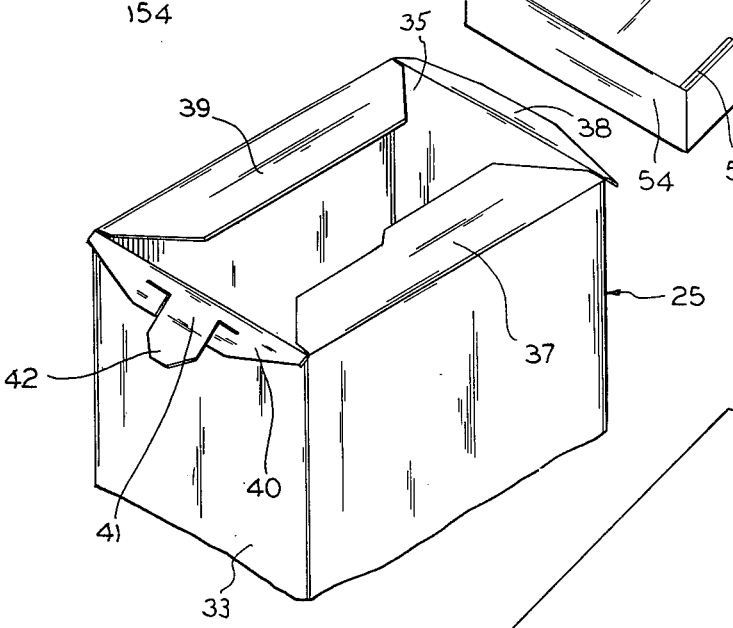

The carton and cover portions of FIGS. 2 and 3 are shown in their articulated form in FIGS. 4 and 5. Bossed ridges 57 and 58 on cover portion 43 are shown in FIGS. 3 and 4, for example, as is bossed ridge 50.

Through the utilization of such bossed ridges, an increased interference fit is capable of being maintained between the cover and the carton portion. Additionally, where aligned bossed ridges are utilized on both the cover and carton portions such as FIG. 9 with ridges 116 and 200, such bossed ridges are capable of sliding past one another for interlocking therebetween. Release tab 42 is also shown in FIG. 4.

In the preferred embodiment of the invention, which is described by FIG. 5, for example, closure flap 37 and 39 on carton 25 would be folded inwardly over the ice-cream contents. Flaps 37 and 39, as do flaps 74 through 77 of FIG. 9 and flaps 122, 126, 128 and 132 of FIG. 13, additionally serve to facilitate removal of the cover from the filled ice-cream container by separating the cover portion from direct contact with the ice-cream. Conventional containers often allow the cover assembly to come into contact with the ice-cream when the container is full and in so doing increase, through adhesion, the attraction between the ice-cream and the cover to make intentional removal of the cover more difficult while, at the same time, dirtying the inside of the cover, as well as the top surface of the ice-cream itself.

Closure flaps 38 and 40, are folded downwardly across the panels from which each of the respective flaps emanates. Closure flap 40 is folded downwardly over the upper portion of side panel 33 while closure flap 38 folds downwardly over the upper portion of side panel 35. As can be seen in FIG. 5, cover 43 is maintained in place on carton portion 25 through the telescopic receipt of cover 43 by the carton portion whereupon shaped panel 40 snaps into recess 45 described in side panel 44 of cover portion 43. Equivalently, shaped closure flap 38 snaps into an equivalent recess shaped in the interior side of side panel 54 of cover portion 43 when the cover portion is attached to the top of carton 25. Release of the cover portion is accomplished by firmly depressing release tab 42 inwardly into panel 33 which, in turn, removes closure flap 40 from its position within recess 45 to enable pivotal detachment of the cover portion around closure flap 38. Bossed ridges 50 and 51, also shown in FIG. 5, lend structural support to the side panels of cover portion 43, while at the same time urging a better and closer interference fit between cover portion 43 and carton portion 25. Recess 45 in side panel 44 of cover portion 43 is formed by a perforation in side panel 44 which permits the edges of recess 45 to protrude so as to form the desired recess region.

A second embodiment of the invention is shown in FIGS. 6 through 9 wherein carton portion 73 relies upon a series of shear protuberances 98, 99, 100 and 203 which cooperate with notched regions such as notched region 204.

Figure 6:
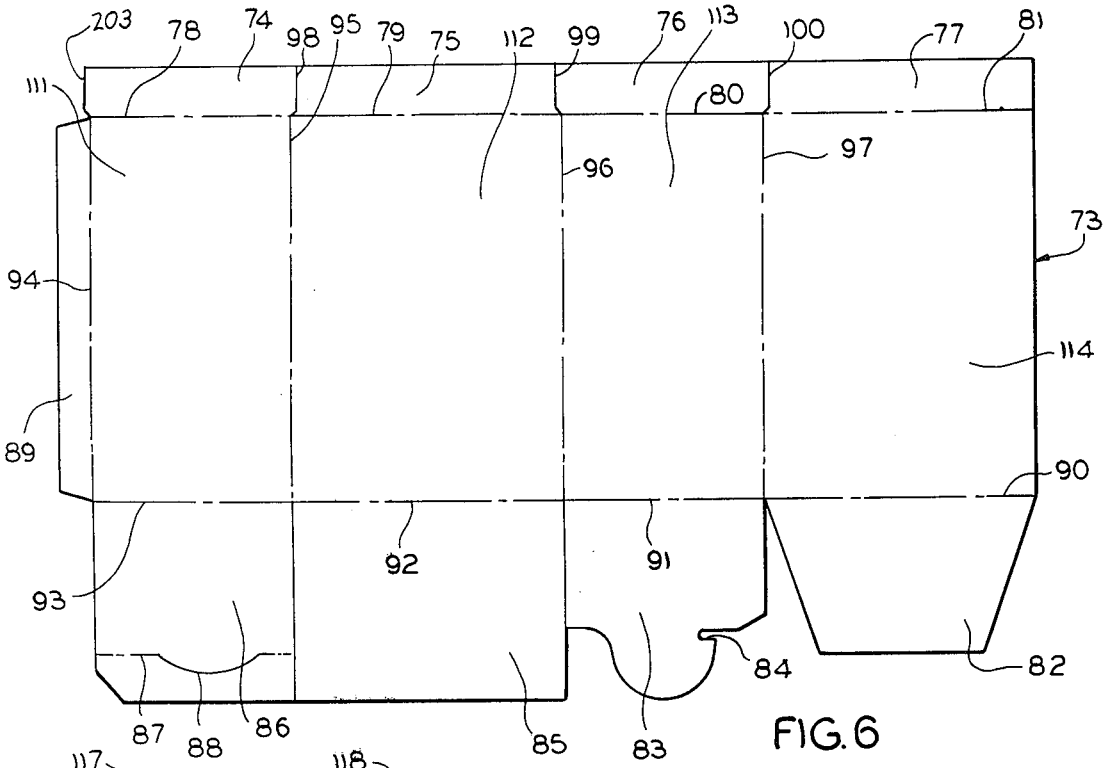
FIG. 6 is a front elevational view of an embodiment of the container in which the carton portion utilizes shear protuberances emanating from the sides of its closure flaps.

In FIG. 6 carton portion 73 can be seen to be made up of side panels 111 and 113, front panel 112 and back panel 114. Closure flaps 74 through 77 are formed at the upper portion of these respective panels and closure flap 74 and 76 have protuberances 203, 98, 99, and 100, respectively, emanating from their sides. Fastening strip 89 connected at fold 94 to panel 111 is also shown. The bottom of carton portion 73 is made up of sealing flaps 85 and 82, tongued flap 83 having notch 84, and slotted flap 86 with slot 88 interrupting fold 87. In this particular embodiment, cover portion 101 shown in FIG. 7, has side panels 106, 109, 117 and 115, as well as fastening strips 102 through 105 which, through adhesion, permit the articulation of the cover portion blank into cover portion 101 as shown in FIG. 9.

Figure 7:
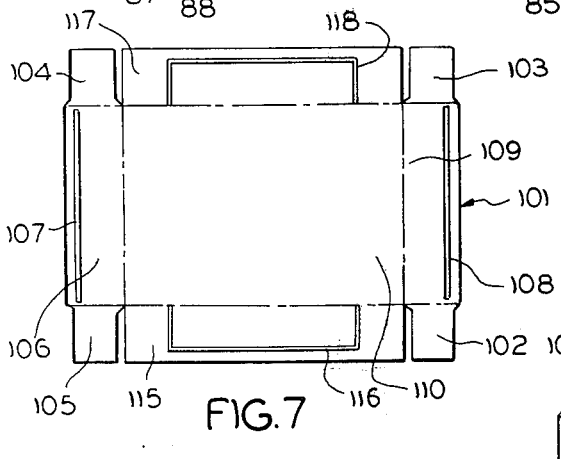
FIG. 7 is a front elevational view of the blank for the cover portion which cooperates with the carton portion of FIG. 6.
Figure 9:
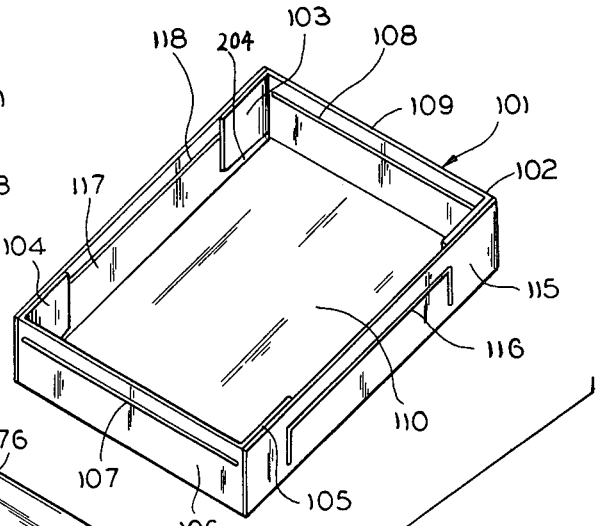
FIG. 9 is a perspective view of the carton and cover portions of FIGS. 6 and 7 respectively after articulation, showing particularly, the interior portions of the carton and cover closure means.
Figure 9:
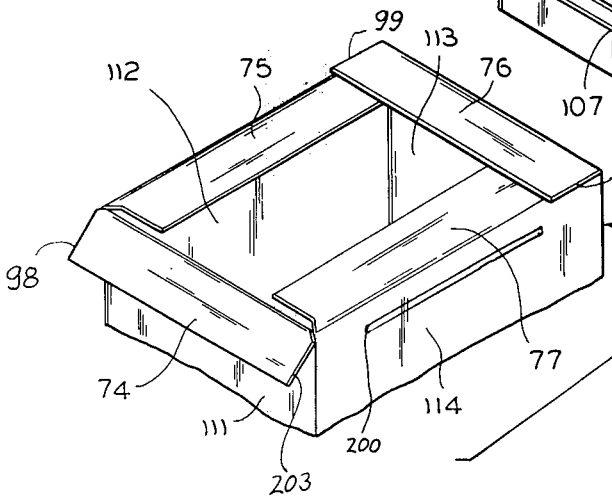

Also shown in both FIGS. 7 and 9 are bossed ridges 116, 118, 107 and 108 for the previously mentioned improved interference fit, structural rigidity, and "snap-behind" fastening features. Bossed ridge 200 on carton portion 73 shown in FIG. 9 is, thus, capable of cooperating with bossed portion 116 when the cover portion is telescopically placed over the top portion of carton 73. The placement of these two bossed ridges, when aligned, enable the snapping behind of one another so as to further securely fasten the cover portion 101 to carton portion 73. Further, in this particular embodiment, all of the closure flaps, namely, 74 through 77 are turned inwardly after the carton is packed with the ice-cream product, with no closure flaps being turned downwardly as in the previously mentioned embodiment. Upon positioning of the cover portion onto carton portion 73, the extending shear protuberances 99, 100, 203 and 98 virtually snap into notched regions such as notched region 204 which is formed by the space between fastening strip 103 and top panel 110 upon articulation. Upon positioning of all four shear protuberances into equivalently fashioned notched regions, the cover is securely fastened into place upon carton 73 requiring increased urging for removal so as to, in turn, guard against inadvertent separation of the cover and carton portions.

Another embodiment of the invention is shown in FIGS. 10 through 13. Carton portion 120 has side panels 145 and 147, front panel 146 and back panel 148. The bottom panel is formed by nested sealing flaps 137 and 140, tongued flap 138 and slotted flap 141. In this particular embodiment of the carton portion, closure flaps 128, 132, 126 and 122 emanate from the upper portion of the respective panels for subsequent cooperation with closure means in the cover portion. This particular embodiment further relies upon shear protuberances which preferably, comprise a combination of two different types of shear protuberances for fastening with the notched regions in the cover portion.

Figure 10:
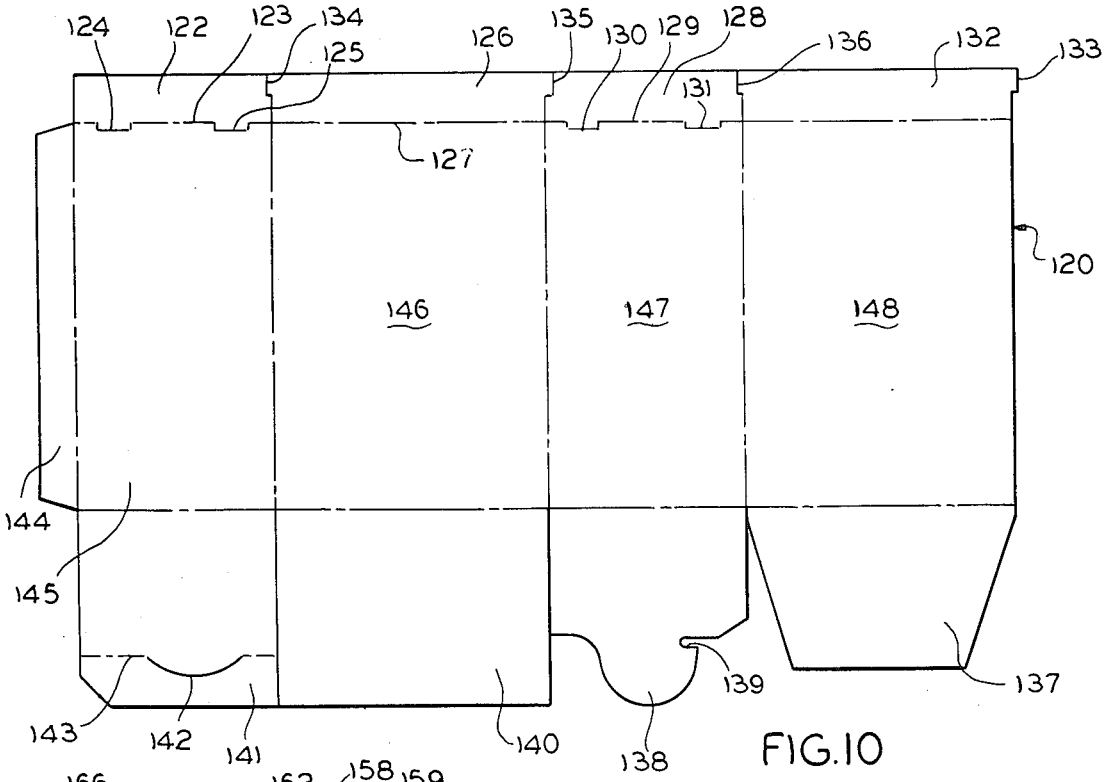
FIG. 10 is a front elevational view of another embodiment of the carton portion blank utilizing shear protuberances emanating from the boundary fold between the panel and closure flaps.
Figure 13:
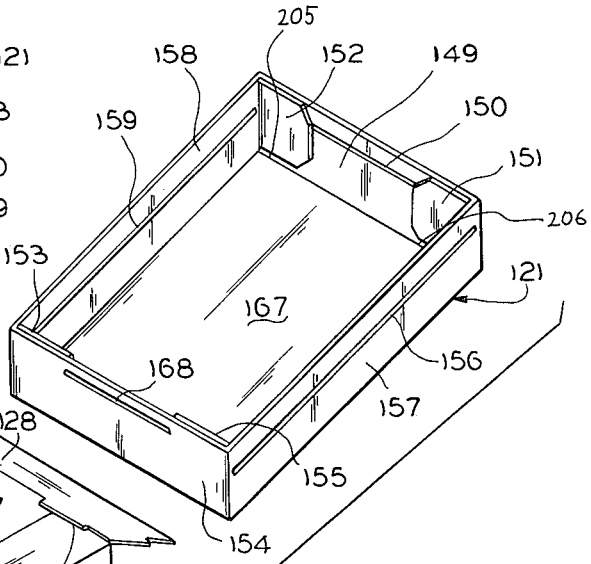
FIG. 13 is a top perspective view (after removal) showing the carton and cover portions of FIGS. 10, 11 and 12, and particularly the closure means associated therebetween.
Figure 13:
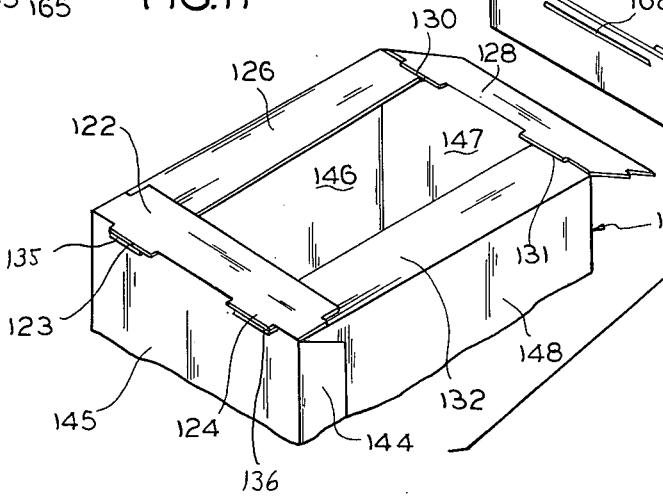

In FIG. 10, shear protuberances 124 and 125 are formed between panel 145 and closure flap 122 by cutting or perforating the packaging material to form the protuberances, which are connected by fold 123. Likewise between panel 147 and flap 128 are fabricated two protuberances 131 and 130 which emanate outwardly when the carton is articulated. In this particular embodiment, additional shear protuberances are utilized, namely, protuberances 134 and 135 emanating from closure flap 126 on panel 146 and protuberances 133 and 136 on closure flap 132 emanating from panel 148. When carton portion 120 is articulated, as shown in FIG. 13, the protuberances from the front and back panels, namely, protuberances 133 through 136 extend through the vacancies left by the other shear protuberances and align with them. In that figure, protuberance 136 is aligned with protuberance 124 and equivalently, protuberance 123 is aligned with protuberance 135 to form a reinforced series of protuberances capable of snapping into notched regions 205 and 206 in cover portion 121.

Figure 11:
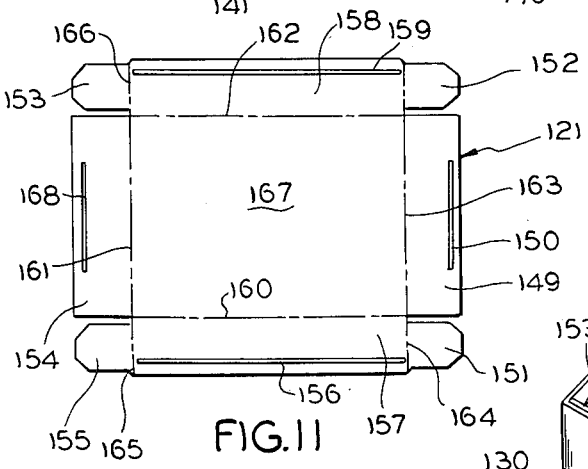
FIG. 11 is a front elevational view of the cover portion blank which cooperates with the embodiment of carton shown in FIG. 10.

In FIG. 11 cover portion 121 is shown in its entirety as comprising top panel 167 and side panels 154, 157, 149 and 158. Strip connection panels 152, 153, 151 and 155 are also shown comprising the means for forming the side panels into an articulated cover portion. Bossed ridges 150, 156, 168 and 159 are also shown as are they shown in FIG. 13. Carton portion 120 is, indeed, capable of utilizing equivalently placed or aligned bossed ridges such as bossed ridge 200 of FIG. 9 for cooperation with the bossed ridges of the cover portion. Cover portion 121 is shown in place atop carton portion 120 in FIG. 12.

Through the use of such shear protuberances in this third embodiment, a close restrained fit is maintained between the cover and carton portions.

Figure 14:
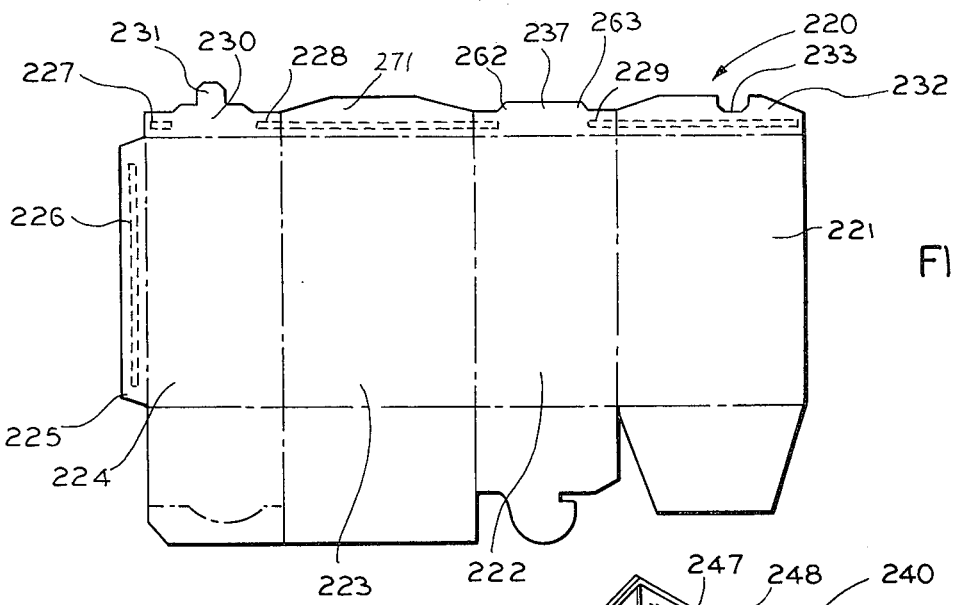
FIG. 14 of the drawings is a front elevational view of a second embodiment of knock-down carton blank in which tab release means are utilized.
Figure 16:
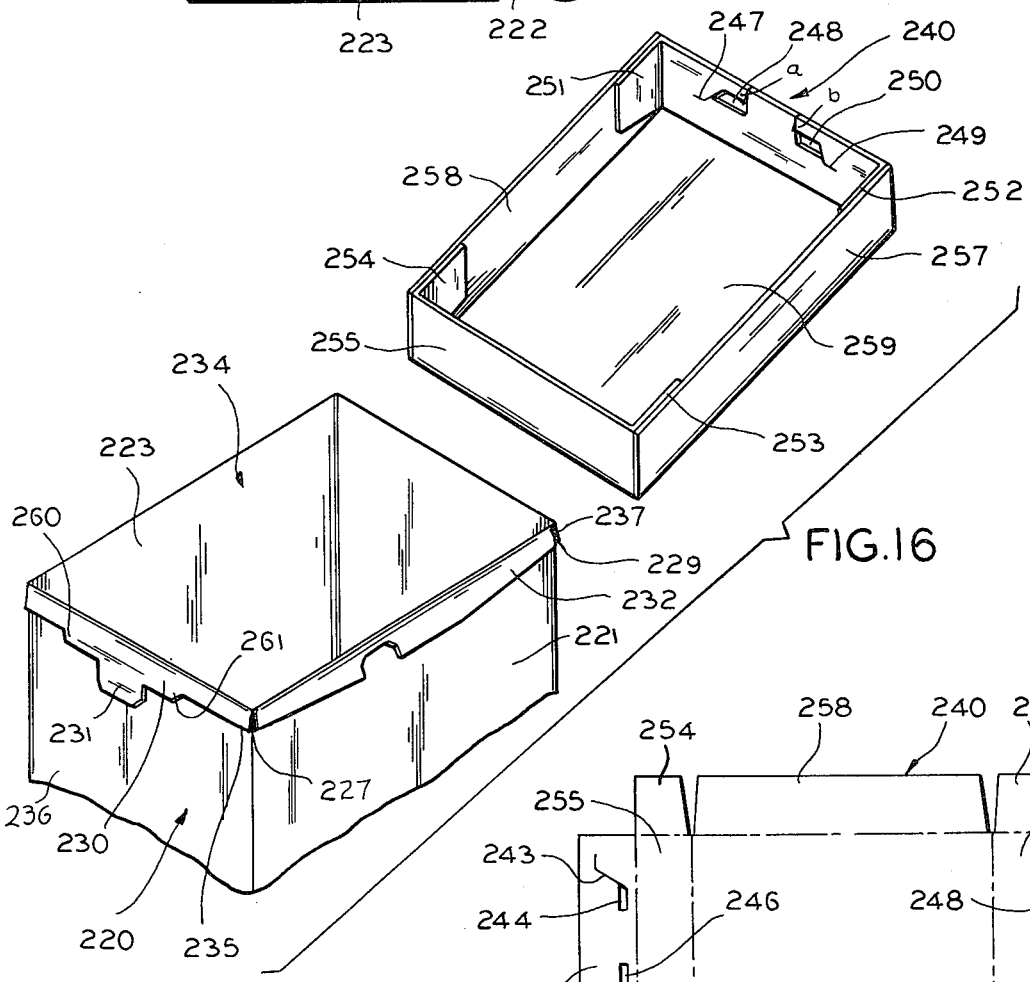
FIG. 16 is a perspective view of the carton and cover portions of FIGS. 14 and 15 respectively after articulation, showing particularly their respective closure means which cooperate to maintain the carton and cover in removably affixed.

The second embodiment in which closure flaps cooperate with release tab means, is shown in FIG. 14. Articulated carton 220 is shown as comprising panels 221 through 224 with carton closure means 232, 237, 271 and 230, respectively. Sealing strip 226 is utilized in restrainably affixing panel 224 juxtaposed to panel 221 upon articulation of carton 220. In the release tab embodiment of FIG. 14, as opposed to the release tab embodiment of FIG. 2, adhesion means comprising adhesive deposits 229, 228 and 227 are utilized to restrainably affix the respective carton closure flaps to their adjacent carton panels when the carton itself is articulated and the flaps are positioned outwardly and downwardly to overlap their respective adjacent carton panels. Accordingly, adhesive deposit 229 maintains closure flap 232 in the substantially restrained overlapping position respective to panel 221, a portion of deposits 228 and 229 do the same for closure flap 237 relative to panel 222. In like fashion, deposit 228 maintains closure flap 271 in position over panel 223 while a portion of deposit 228 and deposit 227, in its entirety, maintain closure flap 230 with release tab means 231 in position overlapping panel 224 as shown in FIG. 16. Adhesive deposit 226 on strip 225 attaches directly to panel 221 upon articulation of the carton blank of FIG. 14. Also shown in FIG. 14 is notch aperture 233 which is exposed when carton 220 is formed from a sheet of carton material, aperture 233 showing the formation of an equivalently shaped carton blank immediately adjacent to carton blank 220. The release tab for said equivalently shaped adjacent carton blank is formed out of material which would have otherwise made up closure flap 232 in a continuous fashion. Carton closure flap 237 is shown as including formed edges 262 and 263 which are specifically shaped for restrainable receipt by appropriate recesses in cover portion 240 as shown in FIG. 16.

Figure 15:
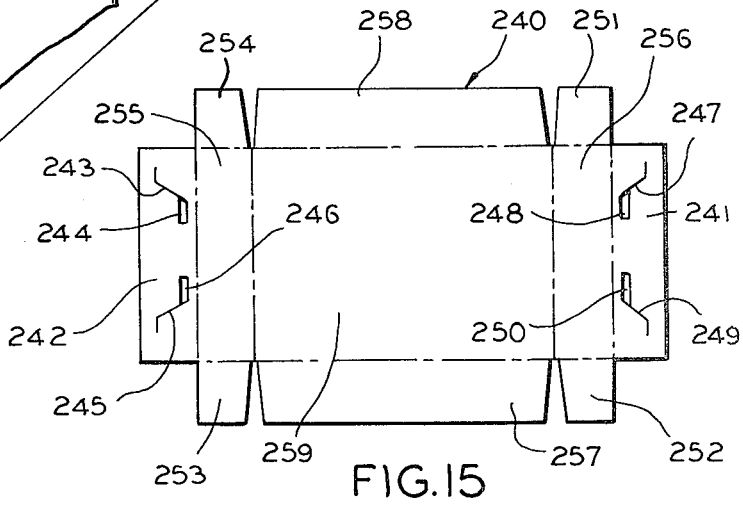
FIG. 15 is a front elevational view of the cover portion which cooperates with the carton blank of FIG. 14.

Cover portion 240 itself is shown in an unarticulated, blank configuration in FIG. 15 as having top panel 259 and side panels 257, 256, 258 and 255, as well as cover strips 251 through 254 which permit articulation of the side panels into the substantially rectangular cover portion shown in FIG. 16. Cover closure flaps 241 and 242 are attached to cover side panels 256 and 255, respectively, at folds to permit the preliminary folding down of flaps 241 and 242 during articulation of cover 240 so that both these elements are facing inwardly for aligned cooperation with carton closure flaps 237 and 230, respectively. In each one of these cover closure flaps, such as closure flaps 241, apertures 248 and 250 are formed, together with score lines 247 and 249 therethrough, so as to create biased retention flaps a and b as shown in FIG. 16. When articulated into cover portion 240, the apertures 248 and 250 in flap 241 expose portions of panel 256, which panel maintains the seal about the cover while the cover is in place on the carton containing ice-cream product.

Cover closure element 242 equivalently has apertures 244 and 246 therein, as well as score lines 243 and 245 through the carton material of flap 242 to create equivalent biased flaps on the opposite facing side of cover portion 240 upon articulation. Apertures 244 and 246 are unexposed to the environment, upon articulation, being sealed by panel 255.

The articulated carton 220 and cover 240 are shown in FIG. 16. Carton closure flaps 230, 232 and 237 are shown restrainably affixed in positions downwardly overlapping their respective panel sections such as closure flap 232 which is shown downwardly overlapping panel 221 and restrainably affixed thereto. Adhesive deposit 229 is seen visable between the uppermost edge of closure flap 237 and its respective overlapped panel in the carton, as well as between closure flap 232 and its respective overlapped panel 221. The same is true relative to closure flap 230 having tab release mechanism 231 which is restrainably affixed to panel 236 through adhesive deposit 227 and a portion of deposit 228 (not shown). Each of the closure flaps is restrainably affixed in a substantially outwardly biased position to their respective panel sections of the carton in order to more effectively bear against their respective mated panels in cover portion 240 when the cover is placed atop the container. Through such a biased construction, carton closure flaps 230 and 237 more effectively spring behind the equivalently shaped recesses and biased flaps a and b of cover flaps 241 and 242 in cover portion 240. Accordingly, shaped portions 260 and 261 of closure flap 230 "snap behind" biased flaps a and b in element 241 to more effectively maintain the cover portion 240 in position atop carton 220 to enclose the contents within cavity 234 until release tab 231 is depressed to permit removal of the cover portion 240 therefrom.

The foregoing description and drawings merely explain and illustrate the invention and the invention is not limited thereto, except insofar as the appended claims are so limited as those skilled in the art who have the disclosure before them will be able to make modifications and variations therein without departing from the scope of the invention.

What is claimed is:

1. A knock-down container assembly for packaging and containing ice-cream products comprising:

a first one-piece blank defining a knock-down rectangular carton portion and a second one-piece blank defining a knock-down cover portion for detachably fixed attachment to said carton portion;

said one-piece, knock-down carton portion comprising a front panel, a back panel, and two side panels interposed therebetween;

carton bottom formation means emanating from the bottom of said carton portion which, when articulated, form a bottom panel on said carton portion;

carton closure means comprising a series of carton closure flaps, one or more of said closure flaps respectively emanating from the top end of one or more of said panels of said carton portion, said one or more of said carton closure flaps being folded outwardly and restrainably affixed in a substantially downward position to the top of said panel from which it emanates;

said cover portion comprising a top panel and a plurality of cover side panels attached to said top panel;

said cover portion, when articulated, having substantially the same shape as the top of said carton portion for telescopic receipt thereover and further being continuously leakproof and free of exposing apertures to preclude inadvertent leakage and contamination of said ice-cream products; and cover closure means carried by said cover portion and comprising recess means formed in one or more of said cover side panels juxtaposed proximate to said series of carton closure flaps upon receipt of said cover portion by said carton portion;

said cover closure means positioned contiguous said outwardly folded panels of said carton portion upon telescopic fitment of said cover portion over said carton portion, said recess means being adapted to detachably and interlockingly receive one or more of said series of carton closure flaps respectively.

2. A knock-down container assembly as defined in claim 1 in which said recess means comprises one or more prescored notch and apertured regions in said side panel forming a substantially bias flapped pocket-like recess for receiving said respective one of said carton closure flaps.

3. The knock-down container assembly as defined in claim 1 wherein the invention further comprises release tab means carried by one of said series of carton closure flaps whereby movement of said release tab means is effective to release one or more of said series of carton flaps from engagement within respective ones of said recess means in said cover portion to permit opening movement of said cover portion relative to said carton portion.

4. The invention according to claim 3 wherein said recess means in said cover closure means comprises a plurality of recesses in one or more of said cover side panels, each of said recesses shaped to singly receive each of said one or more closure flaps of said carton portion respectively, through urging of said closure flaps into said recesses upon said telescopic fitment of said cover portion onto said carton portion, said closure flaps thereby nesting into said recesses to preclude the inadvertent and undesired removal of said cover portion from said carton portion, said release tab means operating when depressed to remove said one or more closure flaps from said one or more respective recesses so as to dislodge the nested flaps from their positions within said respective recesses so as to facilitate removal of said cover portion from said carton portion.

5. The knock-down container assembly as defined in claim 1 in which said one or more of said series of closure flaps is restrained in said substantially downward position relative to the top of its respective carton panel by adhesive deposit means, said adhesive deposit means restraining said closure flap in a substantially outwardly biased position relative to said respective carton panel to more effectively permit interlocking receipt of said closure flap by said recess means in said cover portion.

6. The invention according to claim 1 in which said rectangular carton portion is preliminarily formed into a rectangular-shaped tube through carton strip connection means which fixedly juxtaposes one of said panels proximate to a successive panel.

7. The container assembly of claim 6 wherein said strip connection means comprises an attachment strip fixedly attached to said proximate panel through adhesive affixation.

8. The invention according to claim 1 in which said cover portion is articulated into said shape through cover strip connection means operably interposed between said top and side panels of said cover portion, said cover strip connection means comprising a plurality of cover strips which successively juxtapose the side edges of said panels through adhesive attachment therebetween.

9. The invention according to claim 1 wherein said bottom panel comprises a slotted flap emanating from one of said front, back and side panels and a tongued flap capable of being received by said slotted flap and locked thereinto, said tongued flap emanating from one of said front, back and side panels positioned oppositely from said panel from which said slotted flap emanates.

10. The invention according to claim 8 wherein said bottom panel further comprises a plurality of sealing flaps which nest, when said cover portion is articulated so as to be positioned between said locked tongue and slotted flaps, and the bottom aperture formed by the bottom ends of said front, back and side panels;

each of said sealing flaps emanating from one or more of said panels absent said tongued and slotted flaps.

11. The invention according to claim 1 in which one or more of said cover side panels included cover flaps cooperatively attached thereto, said recess means comprising recesses formed in said cover flaps respectively, each of said recesses shaped to receive each of said one or more closure flaps of said carton portion respectively through urging of said closure flaps into said recesses upon said telescopic fitment of said cover portion onto said carton portion, said closure flaps thereby nesting into said recesses to preclude the inadvertent and undesired removal of said cover portion from said carton portion.

12. The knock-down container assembly as defined in claim 11 wherein the invention further comprises release tab means carried by one of said series of carton closure flaps whereby movement of said release tab means is effective to release one or more of said series of carton flaps from engagement within respective ones of said recess means in said cover portion to permit opening movement of said cover portion relative to said carton portion.

13. The invention according to claim 1 in which said carton closure means comprises two pairs of said closure flaps, each one of said two pairs of closure flaps emanating respectively from each of said side panels in said carton portion.

14. The invention according to claim 1 in which said carton portion comprises a standard rectangularly shaped one-half gallon capacity container.

15. The invention according to claim 1 in which said carton portion is of a standard rectangular size for facilitated adaptation to conventional ice-cream product packaging equipment.

* * * * *